US005429453A

United States Patent [19]

Stroud

[11] Patent Number: 5,429,453

[45] Date of Patent: Jul. 4, 1995

[54] MEANS FOR RESURFACING TENNIS COURTS AND THE LIKE

[76] Inventor: Gordon E. Stroud, 6550 Bose La., San Jose, Calif. 95120

[21] Appl. No.: 195,436

[22] Filed: Feb. 14, 1994

[51] Int. Cl.[6] ..... E02B 11/00; E02D 31/00

[52] U.S. Cl. ..... 405/38; 405/36; 405/229

[58] Field of Search ..... 405/36, 37, 38, 45, 405/50, 229; 52/167 R, 169 RM

[56] References Cited

U.S. PATENT DOCUMENTS

| | | | |
|---|---|---|---|
| 4,044,179 | 8/1977 | Haas | 428/17 |
| 4,440,088 | 4/1984 | Wallace et al. | 405/38 X |
| 4,576,511 | 3/1986 | Vidal | 405/37 |
| 4,679,963 | 7/1987 | Heath | 405/36 |
| 4,832,526 | 5/1989 | Funkhouser | 405/38 X |
| 4,878,780 | 11/1989 | Vidal | 405/38 |
| 4,881,846 | 11/1989 | Burkstaller | 405/37 |
| 4,913,596 | 4/1990 | Lambert | 405/36 X |
| 5,026,207 | 6/1991 | Heath | 405/38 X |
| 5,064,308 | 11/1991 | Almond et al. | 405/36 X |
| 5,074,708 | 12/1991 | McCann | 405/38 |

*Primary Examiner*—David H. Corbin
*Attorney, Agent, or Firm*—Townsend and Townsend Khourie and Crew

[57] ABSTRACT

An improved surface covering for use in tennis courts or other fields on which games are played and which require a hard surface. The surface covering includes layers of materials applied on an old existing covering which is inferior for one or more reasons. The new covering includes a drain rock layer beneath a flexible fabric panel which is beneath a new base rock layer. A layer of asphalt is applied to the base rock layer, following which a thin layer, such as of bitumen or the like, can be applied to the top of the asphalt layer. The new covering will "float" on top of the old covering to allow the old covering to expand or contract due to ground movement while also eliminating moisture problems.

18 Claims, 1 Drawing Sheet

MEANS FOR RESURFACING TENNIS COURTS AND THE LIKE

This invention relates to improvements in soil coverings, including asphalt layers on base layers of rock and, more particularly, to such a covering adapted especially for use in re-surfacing tennis courts or other surfaces on which games are played.

BACKGROUND OF THE INVENTION

Tennis courts have been made from A.C. (asphalt cement) layers or P.C.P. (Portland Concrete Cement) covering the top surfaces of such courts. The asphalt layer of such a court is typically laid over a base rock layer after the base rock layer has been laid onto the soil at a level below ground level. While such a court has been proven useful in many areas of the country, it is not suitable for use in regions where the surface materials are readily affected by moisture and heat as much as ground movement. When the sun evaporates water in the surface or sub-surface, the asphalt and the rock base layer crack and form fissures in the covering itself. These crack result in an inferior surface covering which must either be replaced or repaired, both of which are expensive. Because of the damage which the cracks can do to such a surface covering, a need exists for an improved surface covering which does not crack and which minimizes the effects of ground movement.

Prior disclosures relating to the formation of surface coverings include the following U.S. Patents:

| | |
|---|---|
| 4,044,179 | 4,913,596 |
| 4,679,963 | 5,026,207 |
| 4,832,526 | 5,064,308 |
| 4,878,780 | 5,074,708 |
| 4,881,846 | |

SUMMARY OF THE INVENTION

The present invention is directed to an improved surface covering for use in tennis courts or other fields on which games are played and which require a hard surface. The improved surface covering includes an assembly of layers of materials applied on an old existing covering which is inferior for one or more reasons, including having cracks in the layers of the covering.

The new covering includes a drain rock layer beneath a flexible geo-textile fabric panel which is beneath a new base rock layer. A layer of asphalt (A.C.) is applied to the base rock layer, following which a thin layer, such as of bitumen or the like is applied to the top of the asphalt layer.

A header or form is placed at the sides of the drain rocks layer. By virtue of this construction, the new covering will "float" on top of the old covering to allow the old covering to expand or contract due to ground movement while also eliminating moisture problems.

The textile fabric panel of the new covering can be of any suitable material, such as a durable fabric, such as foraminous material. The textile fabric provides low resistance to the passage of water but prevents finely divided rock from passing through it.

The primary object of the present invention is to provide an improved new surface covering for a tennis court or other game playing field without removing the underlying materials, wherein an asphalt layer at the top of the new covering overlies a base rock layer, a geotextile fabric and a new drain rock layer, the new covering being placed on an old covering which has been typically damaged due to atmospheric heat and moisture, whereby the new covering will "float" on top of the old covering, thus allowing the old covering to expand or contract due to said movements, and also to eliminate moisture and heat problems.

Other objects of the present invention will become apparent as the following specification progresses, reference being had to the accompanying drawings for an illustration of the invention.

DETAILED DESCRIPTION OF THE PREFERRED EMBODIMENT

Figure 1:
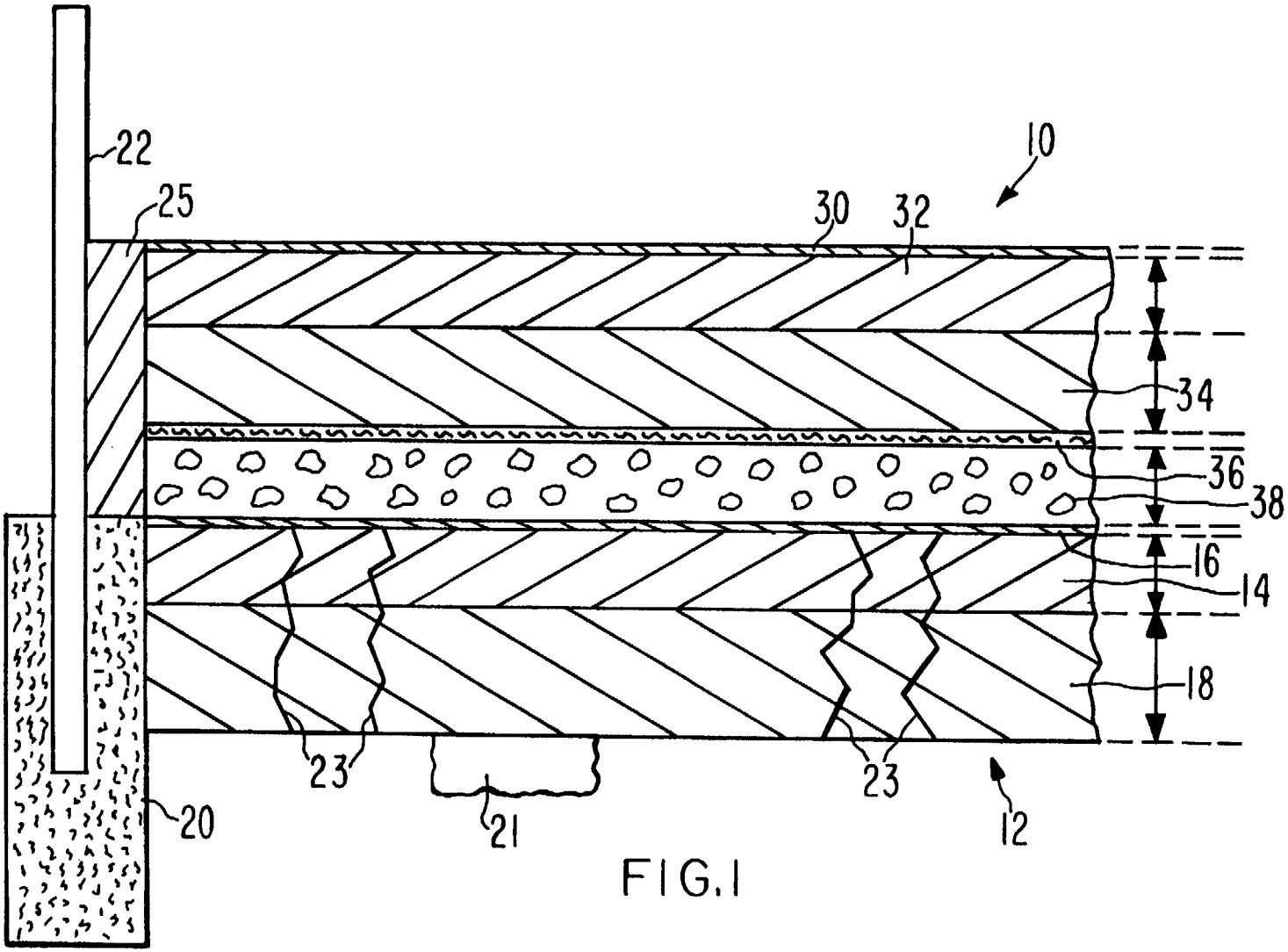
FIG. 1 is a schematic view of a stack of layers of asphalt or P.C.C., drain rock and a textile fabric defining a new covering laid on an old covering and floating on the old covering.

The improved covering for a tennis court or the like is broadly denoted by the numeral 10 and typically is suitable for use in re-surfacing an old covering such as a tennis court of A.C. or P.C.C. The old court or filed to be re-surfaced will hereinafter be denoted by the numeral 12 and it is comprised of a layer 14 of existing asphalt or P.C.C. to various depths in the range typically of 2" to 4". The layer 14 is also subject to various gradations in the range of ¾" to ⅜". The upper surface 16 of the layer 14 is formed of a coating of a bitumen or other suitable hardened layer or coating.

An existing base rock layer 18 is below layer 14 and layer 18 can be to various depths such as in the range of 4" to 12" and of various gradations in size from 1 and ½" to 12" to dust. The layers 14 and 18 are mounted in a concrete support foundation footing and/or header board 20 which encircles the court 12 and is support for a fence 22 or other barrier. The base rock layer 18 is on the upper surface 21 of soil.

The purpose of the new layer assembly or covering 10 is to provide or create a slip plane over a cracked, deteriorated surface of an old covering 12, the cracks being denoted by numeral 23, the cracks typically propagating from the upper surface 16 downwardly through the base rock layer 18. These cracks are formed in the surface 16 and in asphalt layer 14 due to ground movement, moisture and heat.

Assembly 10 includes a new top surface of bitumen or the like, the surface being denoted by the numeral 30 and spreading in a horizontal plane from the header 25, which can be a P.C.C. block.

A new asphalt layer (A.C.) 32 is below layer 30. Layer 32 can typically be of various depths, such as 2" to 3" and of various gradations of rock particle size such as ½" to ⅜". Layer 32 is on a base rock layer 34 which can be of various depths in the range of 4" to 12" and of various particle size gradation of ¾" to dust.

A geo-textile fabric layer 36 is below new base rock section 34 and textile fabric layer 36 rests and is supported by a drain rock layer 38 which rests on old surface 16. Layer 38 can shift relative to the layers adjacent thereto so that shifting of the old covering 12 can occur due to ground movements without damaging the new covering 10. Panel 36 is permeable to water but resists the passage of fine particles therethrough.

It can be seen that the header 25 extends from surface 16 of the old assembly of layers up to the top of layer 30 of assembly on new covering 10. The drain rock layer 38 can be of various depths, such as 2" to 4".

In use, the existing or old surface 12 is kept in place and layers 14 and 18 are prepared by placing a header 25 above the upper surface of support 20. Then, layers 38, 34 and 32 are placed on surface 16 with a fabric layer 36 shiftably placed between layers 34 and 38. The surface 30 is then placed on the upper surface of layer 32.

The ground below the old covering described above will continue to move due to seismic signals and also due to heat and moisture. Such movements do not affect the new covering that is on the old covering. Any moisture in the interior of the new covering will flow through the fabric panel which is essentially no obstruction to moisture. However, the fabric panel keeps the drain rock layer clean and free of any fines which would otherwise gravitate from the new base layer directly beneath the new asphalt layer.

In this way, there is created a slip plane over a cracked, deteriorated covering 12 without replacement of the covering 12 so that the new covering "floats" on the top of the old covering 12.

I claim:

1. An improved ground covering for resurfacing an old ground covering having an upper surface comprising:

a drain rock layer adapted to be mounted on the upper surface of said old covering;

a flexible panel on the drain rock layer and being shiftable relative to the drain rock layer;

a base rock layer on the panel; and an asphalt layer on the base rock layer and spaced above and movable relative to the fabric panel, said panel being shiftable relative to the old covering due to ground movement to thereby permit the new covering to shift relative to the old covering.

2. A covering as set forth in claim 1, wherein is included a header adapted to be placed adjacent to and extending upwardly from the outer periphery of the old covering, said layers extend laterally to the header.

3. A covering as set forth in claim 2, wherein is included a fence adjacent to the header, said header filling the space between the adjacent sides of the layers and the fence.

4. A covering as set forth in claim 1, wherein the drain rock layer has a thickness in the range of 2" to 4" and a gradation in the range of ¼" to 1".

5. A covering as set forth in claim 1, wherein the thickness of the asphalt layer is in the range of 2" to 3" and a gradation in the range of ½" to ⅜".

6. A covering as set forth in claim 1, wherein the thickness of the base rock layer is in the range of 4" to 12" and a gradation in the range of ¾" to dust.

7. A covering as set forth in claim 6, wherein the drain rock layer has a thickness in the range of 2" to 4".

8. An improved covering assembly formed of a first asphalt layer on a first base rock and the first asphalt layer being substantially at ground level, said covering comprising:

a drain rock layer adapted to be mounted on said first asphalt layer;

a flexible fabric panel covering the drain rock layer and being shiftable on the drain rock layer;

a second base rock layer on the fabric panel;

a second asphalt layer on the second base rock layer and spaced above the fabric layer, the drain rock layer having a thickness in the range of 2" to 4", said base rock layer having a thickness in the range of 4" to 12" and a gradation of the range of ¾" to dust, said second asphalt layer having a thickness in the range of 2" to 3" and a gradation of ½" to ⅜".

9. In a ground covering assembly:

an old ground covering;

a new ground covering for resurfacing the old covering, said old covering having a first base rock layer and a first asphalt layer on the first base rock layer, said new covering including:

a drain rock layer on the upper surface of said first asphalt layer;

a flexible fabric panel on the drain rock layer being shiftable relative to the drain rock layer;

a second base rock layer on the fabric panel; and a second asphalt layer on the second base rock layer and spaced above the fabric panel, said fabric panel being shiftable relative to the old covering due to ground movement to thereby permit the new covering to shift relative to the old covering.

10. In an assembly as set forth in claim 9, wherein is included a header adjacent to and extending upwardly from the outer periphery of the old covering, the layers of said new covering extending laterally to the header.

11. In an assembly as set forth in claim 10, wherein is included a fence adjacent to the header, said header filling the space between the adjacent sides of the layers and the fence.

12. In an assembly as set forth in claim 9, wherein the drain rock layer has a thickness in the range of 2" to 4" and a gradation in the range of ¼" to 1".

13. In an assembly as set forth in claim 9, wherein the thickness of the second asphalt layer is in the range of 2" to 3" and a gradation in the range of ½" to ⅜".

14. In an assembly as set forth in claim 9, wherein the thickness of the base rock layer is in the range of 4" to 12" and a gradation in the range of ¾" to dust.

15. In an assembly as set forth in claim 14, wherein the drain rock layer has a thickness in the range of 2" to 4".

16. In combination as set forth in claim 9, wherein the first base rock layer has a thickness in the range of 4" to 12" and a gradation in the range of 1½" to ½" to dust.

17. In combination as set forth in claim 9, wherein the first asphalt layer has a thickness in the range of 2" to 4" and a gradation of ¾" to ⅜".

18. An improved ground surface means:

an old covering for placement on the ground, a new covering on the old covering, said old covering including a first asphalt layer and a first base rock layer, the first asphalt layer being on the first base rock layer and the first asphalt layer being substantially at ground level;

a drain rock layer adapted to be mounted on said first asphalt layer;

a fabric panel on the drain rock layer;

a second base rock layer on the fabric layer;

a second asphalt layer on the second base rock layer and spaced above the fabric layer, the drain rock layer having a thickness in the range of 2" to 4", said base rock layer having a depth in the range of 4" to 12" and a gradation of the range of ¾" to dust, said second asphalt layer having a depth in the range of 2" to 3" and a gradation of ½" to ⅜", the thickness of the first base rock layer is in the range of 4" to 12" and a gradation in the range of 1½ to ½" to dust, said first asphalt layer having a thickness in the range of 2" to 4" and a gradation from ¾" to ⅜".

* * * * *